US006209752B1

(12) United States Patent
Mitchell et al.

(10) Patent No.: US 6,209,752 B1
(45) Date of Patent: Apr. 3, 2001

(54) AUTOMATIC SOAP DISPENSER

(75) Inventors: Joseph Mitchell, Alpharetta, GA (US); John R. Frassanito, Houston, TX (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/265,763

(22) Filed: Mar. 10, 1999

(51) Int. Cl.[7] ..... B67D 5/08

(52) U.S. Cl. ..... 222/63; 222/181.3; 222/214; 222/325

(58) Field of Search ..... 222/52, 63, 181.3, 222/209, 314, 325; 4/623

(56) References Cited

U.S. PATENT DOCUMENTS

| | | | |
|---|---|---|---|
| 3,273,752 | 9/1966 | Horeczky . | |
| 3,327,901 | 6/1967 | Yerkovich . | |
| 3,419,188 | 12/1968 | Matchett . | |
| 3,434,628 | 3/1969 | Ceraldi . | |
| 3,531,021 | 9/1970 | Bassett . | |
| 3,639,920 | 2/1972 | Griffin et al. . | |
| 3,749,285 | 7/1973 | Latham, Jr. . | |
| 4,256,242 | 3/1981 | Christine . | |
| 4,546,904 | 10/1985 | Frassanito . | |
| 4,621,749 | 11/1986 | Kanfer . | |
| 4,645,094 | 2/1987 | Acklin et al. . | |
| 4,722,372 | 2/1988 | Hoffman et al. . | |
| 4,839,039 | 6/1989 | Parsons et al. . | |
| 4,917,265 | 4/1990 | Chiang . | |
| 4,921,131 | 5/1990 | Binderbauer et al. . | |
| 4,921,150 | 5/1990 | Lagergren et al. . | |
| 4,938,384 | 7/1990 | Pilolla et al. . | |
| 4,946,070 | 8/1990 | Albert et al. . | |
| 4,946,072 | 8/1990 | Albert et al. . | |
| 4,967,935 | 11/1990 | Celest . | |
| 4,989,755 | 2/1991 | Shiau . | |
| 5,105,992 | 4/1992 | Fender et al. . | |
| 5,186,360 | 2/1993 | Mease et al. . | |
| 5,255,822 | 10/1993 | Mease et al. . | |
| 5,305,916 | 4/1994 | Suzuki et al. . | |
| 5,344,047 | 9/1994 | Chen . | |
| 5,379,917 * | 1/1995 | Brown et al. | 222/325 |
| 5,477,984 | 12/1995 | Sayama et al. . | |
| 5,492,247 | 2/1996 | Shu et al. . | |
| 5,507,413 | 4/1996 | Chen . | |
| 5,540,362 | 7/1996 | Azuma et al. . | |
| 5,611,465 | 3/1997 | Lee et al. . | |
| 5,938,076 * | 8/1999 | Ganzeboom | 222/63 |

* cited by examiner

*Primary Examiner*—Joseph A. Kaufman
(74) *Attorney, Agent, or Firm*—Nelson Mullins Riley & Scarborough

(57) ABSTRACT

A soap dispenser of the type in which a disposable soap cartridge is maintained in a wall-mounted housing is configured for automatic operation. A quantity of soap is dispensed when a user's hand, detected by optical reflectivity, is located proximate to the dispenser housing. In order to prevent reliance on AC power, the device is powered from self-contained batteries and/or solar power cells. In one embodiment, a generally flat battery may be included with the disposable soap cartridge such that a new battery is provided each time the cartridge is replaced. Alternatively, or in addition, solar panels may be located on the dispenser housing. The solar panels may be used to charge energy storage components located in the housing, such as a rechargeable battery or storage capacitors. The solar panels are preferably of a type which is suitably efficient in fluorescent (blue) lighting conditions.

22 Claims, 8 Drawing Sheets

AUTOMATIC SOAP DISPENSER

BACKGROUND OF THE INVENTION

The present invention relates generally to dispensers for liquid soap and other viscous materials. More particularly, the invention relates to devices that automatically detect the presence of a user's hand and dispense a predetermined quantity of the viscous material.

Wall-mounted dispensers for liquid soap or other viscous material, such as hand lotion, are widely used in public and commercial buildings. Often, the dispenser will be constructed having a support base attached to the wall. A pivotal cover is closable on the base to define a housing in which components of the dispenser are contained. The viscous material is located in a storage bag or the like provided as part of a disposable cartridge located in the housing's interior. The disposable cartridge includes a tube forming a peristaltic pump through which the viscous material is dispensed.

Many dispensers of the prior art operate manually, wherein a lever is moved by the user when a quantity of the viscous material is desired. Alternatively, the dispenser may be adapted for automatic operation. In devices of this type, a photoelectric detection circuit is typically provided to sense the presence of a user's hand near the dispenser. When the hand is detected, the device actuates the peristaltic pump to thereby release a predetermined quantity of the viscous material.

Due to the use of electrical and electromechanical components therein, automatic dispensers require a source of power in order to operate. In some cases, the dispenser may be adapted for AC operation from a conventional wall outlet. Often, however, AC operation has been seen as undesirable, in part because it limits the potential locations at which the dispenser can be installed.

In order to overcome the disadvantages of using AC power, dispensers have been provided that operate from battery power. These dispensers, however, have typically employed general purpose batteries, such as D-cells. Because such batteries are relatively large, the dispenser housing must be appropriately sized. In addition, batteries of this type are often subject to frequent replacement.

SUMMARY OF THE INVENTION

The present invention recognizes and addresses the foregoing disadvantages, and others of prior art constructions and methods. Accordingly, it is an object of the present invention to provide a novel dispenser for viscous material such as liquid soap.

It is a further object of the present invention to provide an automatic dispenser for viscous material having various novel arrangements for providing operational power.

It is a more particular object of the present invention to provide an automatic dispenser for viscous material that employs a compact battery incorporated into the disposable soap cartridge.

It is also a particular object of the present invention to provide an automatic dispenser for viscous material that employs solar power cells to provide primary or supplemental power for operation thereof.

Some of these objects are achieved by a dispenser for automatically dispensing viscous material. The dispenser comprises a base, and a cover movable between an open position and a closed position. The cover and base define a housing for containing components of the dispenser when the cover is in the closed position. A disposable cartridge is also provided, having a reservoir of viscous material to be dispensed through a dispensing tube. The disposable cartridge further includes at least one generally flat battery.

The dispenser also includes a mechanical actuator, configured to engage the dispensing tube of the disposable cartridge such that a quantity of the viscous material is dispensed therethrough. Detection circuitry is operative to detect presence of a user's hand at a predetermined location near the dispenser. A motor is operative in response to the detection circuitry to cause movement of the mechanical actuator.

The generally flat battery will preferably define terminal portions engaged by fixed terminals when the disposable cartridge is inserted in the housing. The fixed terminals, for example, may comprise respective spring elements to facilitate firm engagement against the terminal portions of the generally flat battery. Often, the generally flat battery may be carried on a side surface of the disposable cartridge.

In some exemplary embodiments, the dispenser may further comprise at least one solar power cell operative to supplement power supplied by the generally flat battery. For example, the solar power cell may be operative to charge at least one supplemental power storage component, such as one or more batteries or storage capacitors, located in the housing. The circuitry of the dispenser may be configured such that substantially all power to operate the motor is derived from the generally flat battery of the disposable cartridge and substantially all power to operate the detection circuitry is derived from the supplemental power storage component.

Other objects of the invention are achieved by a dispenser for automatically dispensing viscous material. The dispenser comprises a base, and a cover movable between an open position and a closed position. The cover and base define a housing for containing components of the dispenser when the cover is in the closed position. A disposable cartridge is also provided, having a reservoir of viscous material to be dispensed through a dispensing tube.

The dispenser also includes a mechanical actuator, configured to engage the dispensing tube of the disposable cartridge to cause a quantity of the viscous material to be dispensed therethrough. Detection circuitry is operative to detect presence of a user's hand at a predetermined location near the dispenser. A motor is operative in response to the detection circuitry to cause movement of the mechanical actuator.

At least one solar power cell, which may comprise a solar panel mounted on the cover, is also provided to charge at least one supplemental power storage component. Preferably, the solar power cell may be of the type which is suitably efficient in conditions of fluorescent lighting. The supplemental power storage component, located in the housing, supplies power to at least the detection circuitry of the dispenser.

Often, the supplemental power storage component may comprise at least one rechargeable battery. The rechargeable battery may comprise a nonmemory-type battery, such as a nickel-metal-hydride battery or a lithium ion battery. In some embodiments, the supplemental power storage component may comprise at least one storage capacitor.

Additional objects of the invention are achieved by a dispenser for automatically dispensing viscous material. The dispenser comprises a wall-mounted housing in which a disposable cartridge having a reservoir of viscous material to be dispensed is located. The disposable cartridge further includes a generally flat battery, defining terminal portions engaged by fixed terminals.

The dispenser further comprises a mechanical actuator operative to cause a quantity of the viscous material to be dispensed from the reservoir. Detection circuitry, including a light emitter and a light sensitive receiver, is operative to detect presence of a user's hand at a predetermined location near the dispenser. A motor is operative in response to the detection circuitry to cause movement of the mechanical actuator.

At least one solar power cell is located on the housing to receive ambient light. The solar cell charges at least one supplemental power storage component located in the housing for supplying power to at least the detection circuitry. Often, the supplemental power storage component may comprise at least one rechargeable battery, such as a nonmemory-type battery. In some cases, the supplemental power storage component may comprise at least one storage capacitor.

Still further objects of the present invention are achieved by a disposable cartridge for use in a wall-mounted dispenser device of the type operative to automatically dispense viscous material such as liquid soap by a discrete quantity with each actuation. The cartridge comprises a cartridge box having a top, bottom and a plurality of sides. A flexible bag, located in the box, contains a supply of the viscous material. A peristaltic pump in fluid communication with the flexible bag includes a tube extending away from the box. The tube is compressible to cause the discrete quantity of viscous material to be dispensed therethrough. The cartridge further includes a generally flat battery defining terminal portions engaged by fixed terminals when the disposable cartridge is inserted in the dispenser.

Still further objects of the present invention are achieved by a dispenser for automatically dispensing viscous material. The dispenser comprises a base, and a cover movable between an open position and a closed position. The cover and base define a housing for containing components of the dispenser when the cover is in the closed position. A disposable cartridge is also provided, having a reservoir of viscous material to be dispensed through a dispensing tube.

The dispenser also includes a mechanical actuator, configured to engage the dispensing tube of the disposable cartridge such that a quantity of the viscous material is dispensed therethrough. Detection circuitry is operative to detect presence of a user's hand at a location near the dispenser. A motor, operative in response to the detection circuitry, causes movement of the mechanical actuator.

In this case, the motor and detection circuitry of the dispenser are configured such that together they require no more than about 350 $\mu$A of current during operation. At least one solar power cell is provided having sufficient output under fluorescent lighting conditions to substantially completely power the detection circuitry and the motor.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 2:
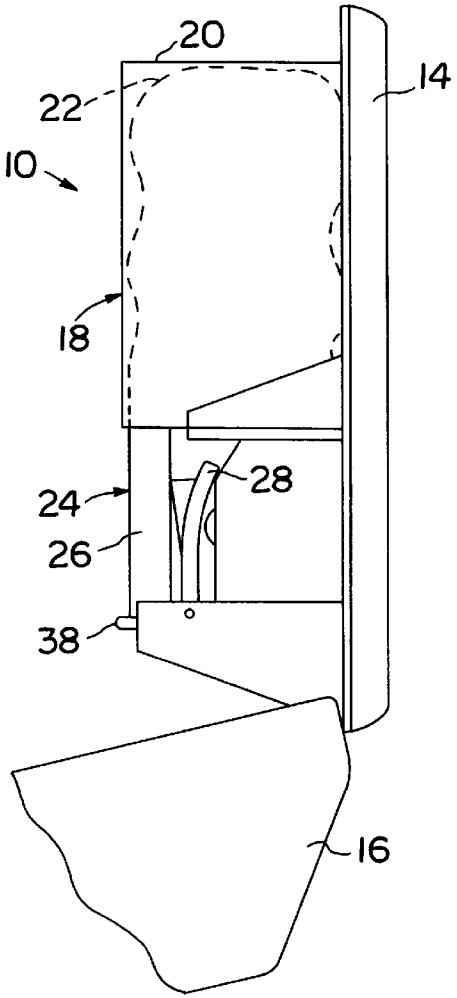
FIG. 2 is a side elevation of the dispenser of FIG. 1 with the cover in the open position.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

Figure 1:
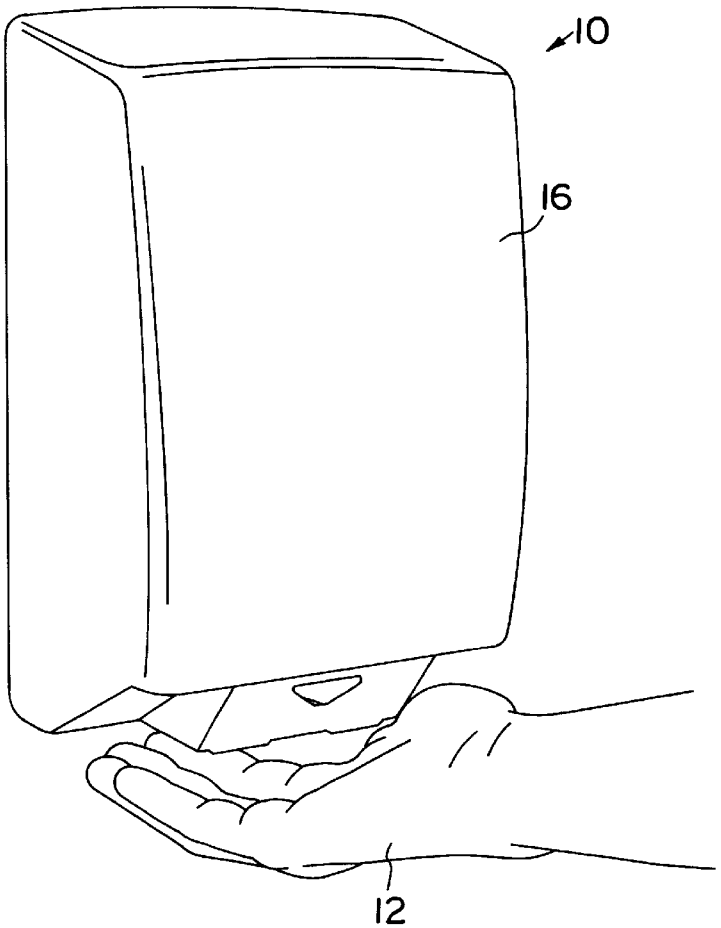
FIG. 1 is a perspective view of an automatic dispenser of the present invention as it may appear in use.

FIG. 1 illustrates a dispenser 10 of the present invention as it may appear when installed on a wall or other vertical surface. Dispenser 10 operates automatically to meter a predetermined amount of soap, lotion or other viscous material into the hand 12 of a user. Preferably, the user is not required to touch the dispenser in order to cause the viscous material to be dispensed. Instead, dispenser 10 contains proximity circuitry operative to determine when hand 12 is in the correct position to receive the viscous material.

Referring now to FIG. 2, dispenser 10 is constructed having a base 14 configured for attachment to the wall or other vertical surface. A cover 16 is pivotally attached for movement between an open position (as shown in FIG. 2) and a closed position (as shown in FIG. 1). In the closed position, base 14 and cover 16 form a housing in which various other components of dispenser 10 are contained.

Among the other components within dispenser 10 is a disposable cartridge 18 containing a supply of the viscous material to be dispensed. Cartridge 18 includes a box 20, typically formed of paperboard, in which a flexible bag 22 is located. Bag 22 serves as the reservoir of viscous material to be dispensed through a peristaltic pump assembly 24. As shown, pump assembly 24 includes an elongate tube 26 extending away from box 20. Tube 26 is compressible, by operation of a mechanical actuator 28, to meter the predetermined quantity of viscous material. Preferably, pump assembly 24 will include one or more check valves to ensure flow of the viscous material in the desired direction.

It will be appreciated that various types of mechanisms may be utilized to compress tube 26. As shown most clearly in FIGS. 3 through 4, however, mechanical actuator 28 comprises an upstanding element 30 having a suitable engaging portion 32 located thereon. As shown, upstanding element 30 is pivotally connected to a shelf 34 integrally extending out from base 14. Shelf 34 defines a slot 36 in which a fitting 38 (FIG. 2), located at the end of tube 26, is received.

Shelf 34 supports an internal compartment 40 in which various elements used to effect movement of mechanical actuator 28 are located. In this case, a drive motor 42 includes a worm gear 44 located on its shaft. Rotation of worm gear 44 causes movement of an elliptical cam 46 through gear stages 48, 50 and 52. The shaft 56 on which cam 46 and gear 54 are mounted also carries a "time out" cam 58. Cam 58, in turn, engages a roller 60 carried by a microswitch device 62.

Microswitch 62 functions to shut off operation of motor 42 after cam 46 is rotated back to its "at rest" position. Preferably, microswitch 62 is mounted to a circuit board 64 which carries various electronic components used to detect the presence of a user's hand as well as to control operation of motor 42. In presently preferred embodiments, the detection circuitry utilizes the optical reflectivity of the user's hand to detect its presence near dispenser 10. It should be distinctly understood, however, that various types of active and passive proximity detection circuits may be utilized for this purpose.

In the illustrated embodiment, a suitable light source, such as a light-emitting diode (LED) 66, which will often operate in wavelengths other than visible light, emits a light signal. When the user's hand is near, this light signal is reflected back to a light sensitive receiver 68. Preferably, the circuitry will be adapted to detect the user's hand up to a range of about three to four inches, irrespective of the skin tone of the user. LED 66 and detector 68 are electrically connected to circuitry contained on circuit board 64.

Referring now to FIGS. 5–8, dispenser 10 is constructed to obviate the need for AC power, as well as relatively large batteries as have often been used in the past. According to one aspect of the invention, the need for battery replacement is largely eliminated by incorporating the battery into disposable cartridge 18. Because a new battery is provided each time cartridge 18 is replaced, the need to frequently monitor the condition of the batteries is eliminated.

In the illustrated embodiment, cartridge 18 includes a generally flat battery 70 attached to the back side of box 20. As shown, battery 70 defines a pair of opposite polarity terminals 72 and 74 on its outwardly directed surface. When box 20 is seated on shelf 76 of base 14, battery terminals 72 and 74 are engaged by corresponding fixed terminals 78 and 80.

As shown, fixed terminals 78 and 80 may include springs to facilitate good electrical contact with the battery terminals. Alternatively, the fixed terminals may be made of spring steel configured to firmly engage the battery terminals. Particularly in this latter case, it may be desirable to form a suitable slot structure in base 14 to slidably receive the flat battery as disposable cartridge 18 is set in place. Because the battery itself will be captured in the slot, good contact between the battery terminals and the fixed terminals will be ensured.

If low power actuation circuitry is used, the battery of cartridge 18 can be made relatively small while still permitting the entire contents of flexible bag 22 to be dispensed. In this regard, it has been found that commercially available batteries may effectively dispense the entire contents of a typical 500 ml replacement cartridge. In one preferred arrangement, the detection circuitry and motor may be adapted to consume no more than about 350 $\mu$A of current during their operation. An experiment using liquid soap as the viscous material to be dispensed showed that a Polaroid Polapulse 6-Volt P100 battery, rated to deliver 1 mA for 264 hr (264 mAH), may deliver at least 720 ml of soap in 1 ml increments prior to battery failure.

Figure 9:
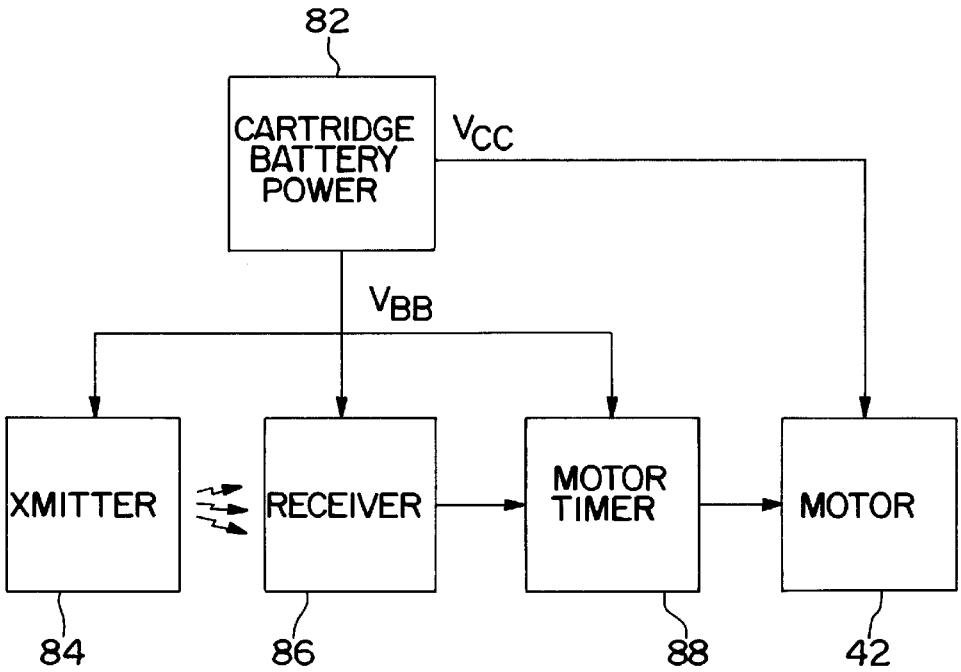
FIG. 9 is a block diagram showing various functional components that may be employed in the dispenser of FIG. 1.

Various functional sections of the circuitry employed in a preferred embodiment of dispenser 10 are illustrated in FIG. 9. As indicated at 82, appropriate circuitry is provided in order to condition electrical power for use by other components. In this case, power circuitry 82 supplies a first output $V_{cc}$ directly to motor 42. The voltage $V_{cc}$ is, in this case, essentially a direct output from battery 70. A filtered voltage $V_{bb}$ is provided by power circuitry 82 to the remaining electrical components.

Figure 3:
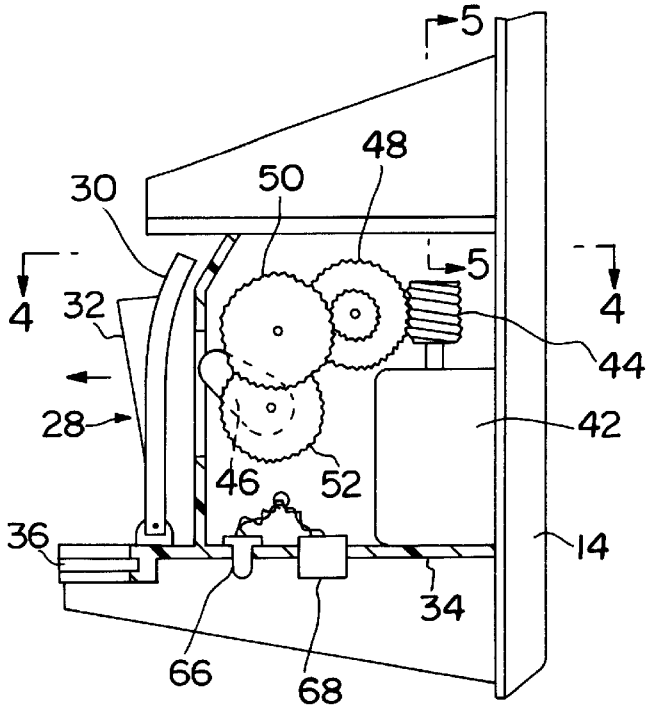
FIG. 3 is an enlarged view, partially in section, showing certain internal components of the dispenser of FIG. 1.
Figure 4:
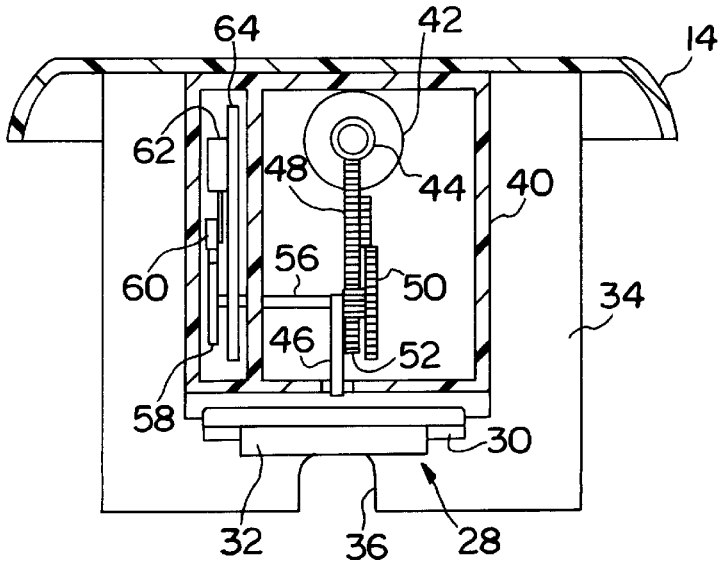
FIG. 4 is a view as taken along line 4—4 of FIG. 3.
Figure 5:
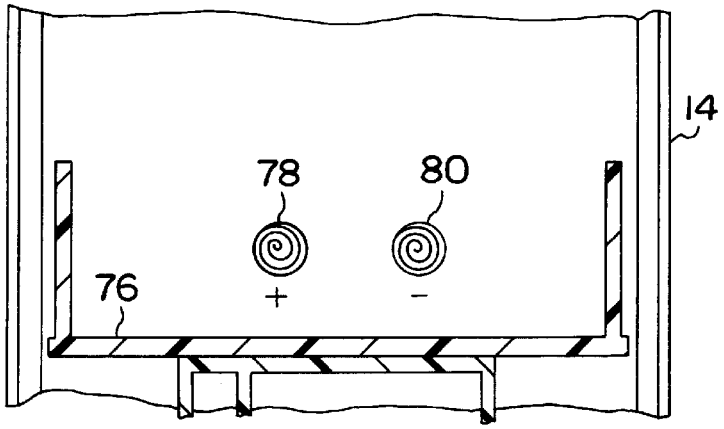
FIG. 5 is a view as taken along line 5—5 of FIG. 3.
Figure 6:
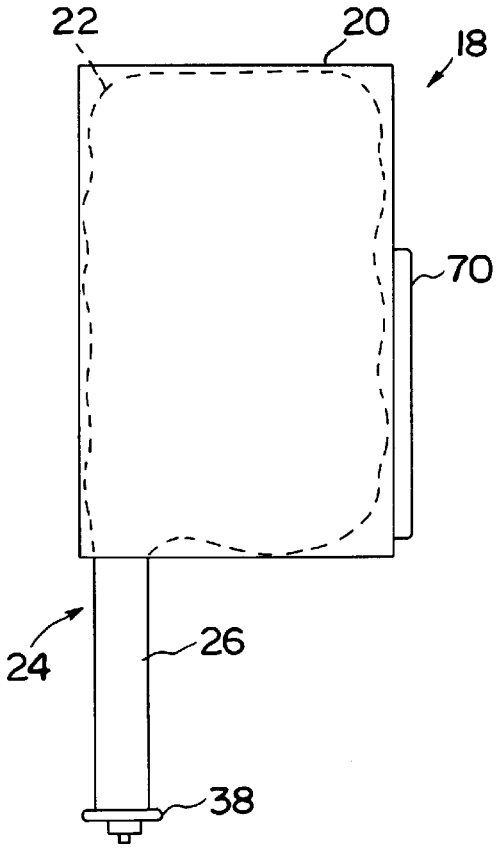
FIG. 6 is a side elevation of a disposable soap cartridge of the present invention, utilized in the dispenser of FIG. 1.
Figure 7:
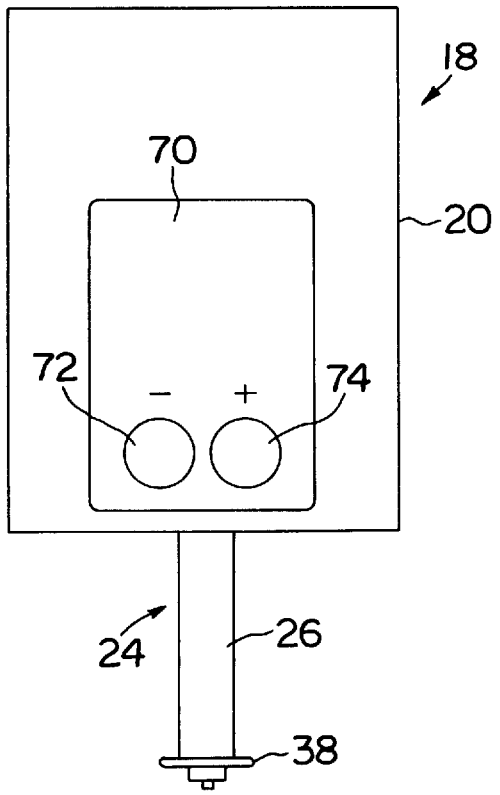
FIG. 7 is a back elevational view of the disposable soap cartridge of FIG. 6 showing details of the battery and terminals thereof.
Figure 8:
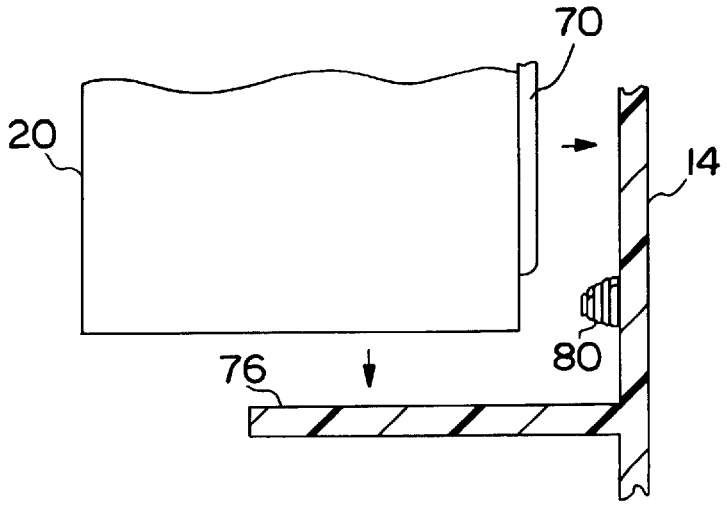
FIG. 8 is an enlarged diagrammatic view showing the manner in which a disposable cartridge is inserted into the dispenser housing such that electrical contact with the cartridge battery is achieved.

The remaining functional components include transmitter circuitry 84, which causes emission of light by diode 66 (FIG. 3). As noted above, this light is then received at detector 68 (FIG. 3) if reflected by a hand. Detector 68 is included within receiver circuitry 86, which provides a responsive signal to motor timer circuitry 88. Upon receipt of a momentary signal from receiver circuitry 86, motor timer circuitry 88 will provide a long duration signal to motor 42. As a result, motor 42 will operate for a time sufficient to dispense the desired quantity of viscous material.

Figure 10:
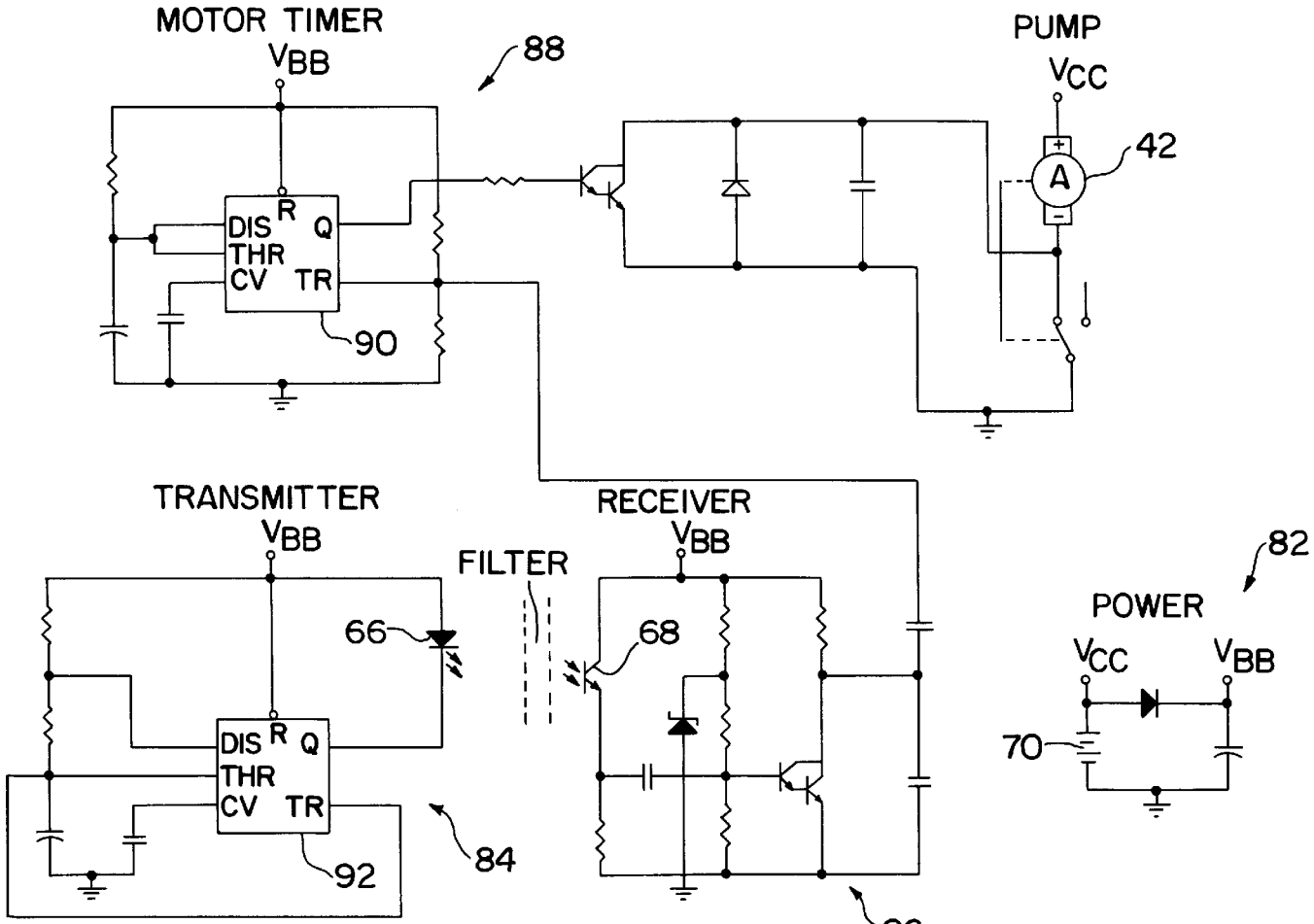
FIG. 10 is a schematic diagram of one preferred circuit arrangement that may be used to implement the functional components shown in FIG. 9.

FIG. 10 illustrates a preferred circuit arrangement constructed in accordance with the functional relationships illustrated in FIG. 9. The structure and operation of the circuitry shown in FIG. 10 will be apparent to one skilled in the art. It should be noted, however, that the integrated circuits (ICs) indicated at 90 and 92 may be respective timer sections of a single RC 556 dual timer chip.

Figure 11:
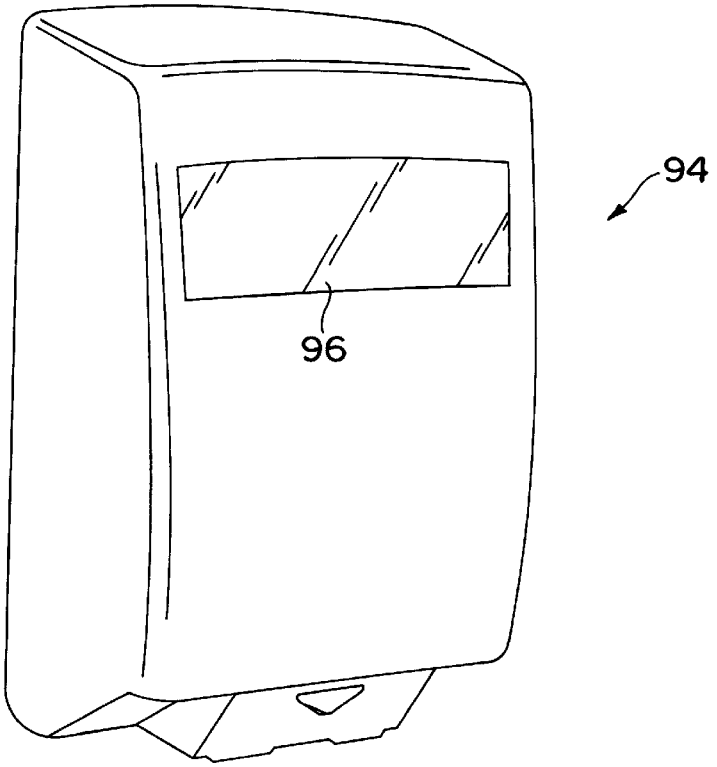
FIG. 11 is a perspective view of a modified automatic dispenser in accordance with the present invention, including solar power cells installed on the dispenser housing.

It will be appreciated that the size, and thus the cost, of the battery included within the disposable cartridge can be further reduced if supplemental power is provided to the circuitry within the dispenser. Thus, FIG. 11 illustrates a modified dispenser 94 in which a solar panel 96 is mounted to the exterior of the housing. Because dispenser 94 will often be used in public bathrooms and other such locations, it is desirable that solar panel 96 have sufficient efficiency in the presence of fluorescent (blue) light. In this regard, certain solar cells are known to provide adequate levels of efficiency in fluorescent light, in addition to also having adequate efficiency in sunlight and incandescent lighting. For example, one such cell, available from Entech Corporation of Dallas, Tex., produces 7.1 VDC at a maximum current output of 174.8 mA.

Figure 12:
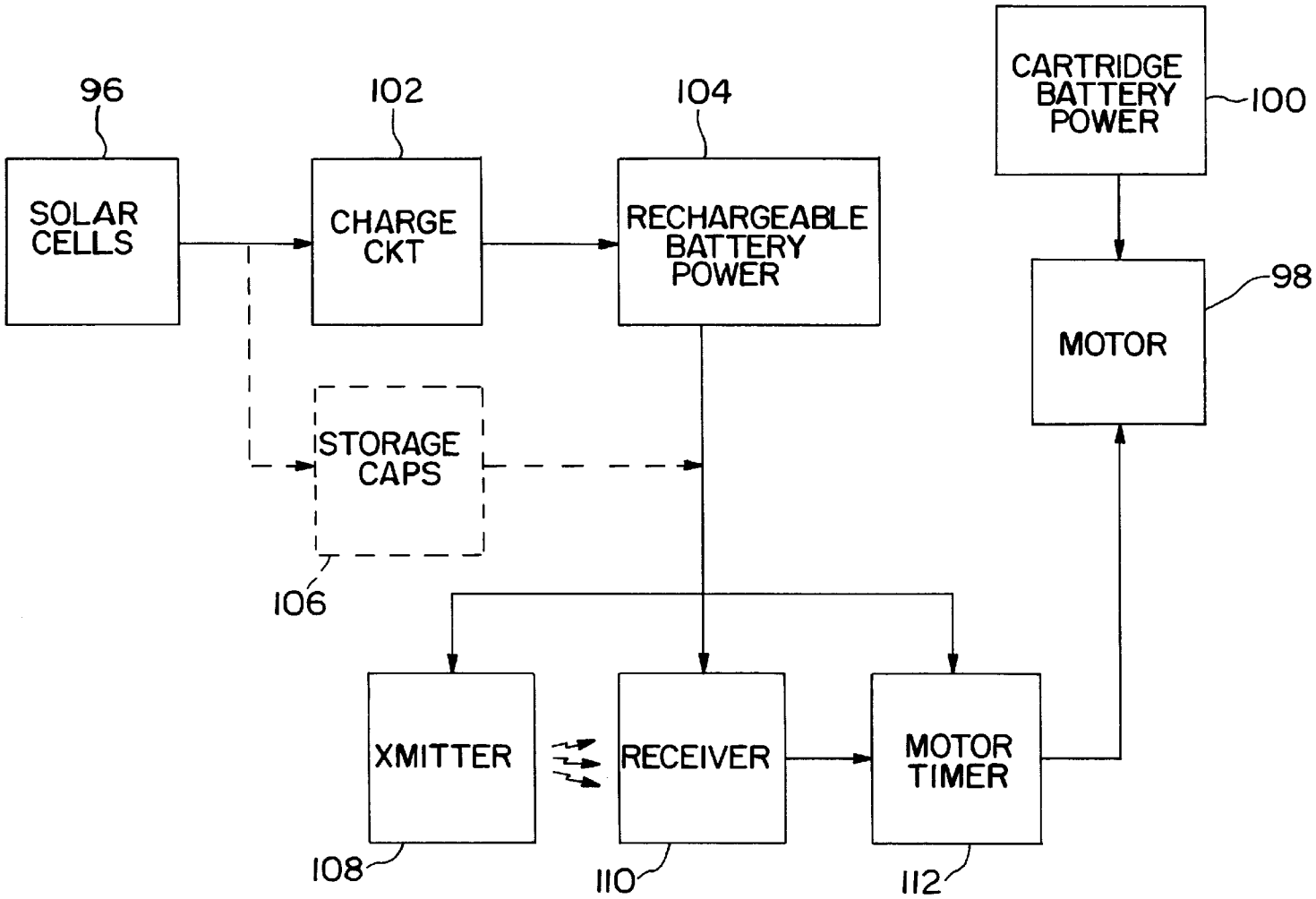
FIG. 12 is a block diagram showing various functional components that may be employed in one embodiment of a dispenser including solar power cells as shown in FIG. 11.

FIG. 12 illustrates one arrangement whereby solar power can be used to supplement power supplied by the disposable battery. In this case, the power supply is bifurcated such that substantially all of the power used to operate motor 98 is derived from the cartridge battery power circuit indicated at 100. Substantially all of the power to operate the remaining portions of the overall circuit is derived from solar panel 96.

In some cases, it may be feasible to power the various circuit components directly from the output of solar panel 96. Often, however, it will be desirable to provide one or more storage components at which charge supplied by solar panel 96 is stored for later use. For example, solar panel 96 may not provide a sufficient level of current at all times, but may provide, on average, a sufficient level of current from which to operate the desired circuitry.

In one preferred embodiment, the output of solar panel 96 is used to maintain a charge, through charging circuitry 102, on one or more rechargeable batteries 104. The rechargeable batteries are preferably of a non-memory type, such as nickel metal hydride or lithium ion batteries. In addition to or in lieu of rechargeable batteries 104, the output of solar panel 96 may be used to maintain a charge across storage capacitors 106 having a sufficient capacitance value.

As shown, power derived from solar panel 96 is used to operate transmitter circuitry 108, receiver circuitry 110, and motor timer circuitry 112. As described above with respect to FIG. 9, transmitter circuitry 108 functions to emit a light signal which is detected by receiver circuitry 110 when a user's hand is present. Receiver circuitry 110 supplies a trigger signal to motor timer circuitry 112, which then provides an actuation signal of relatively long duration to motor 98.

Figure 13:
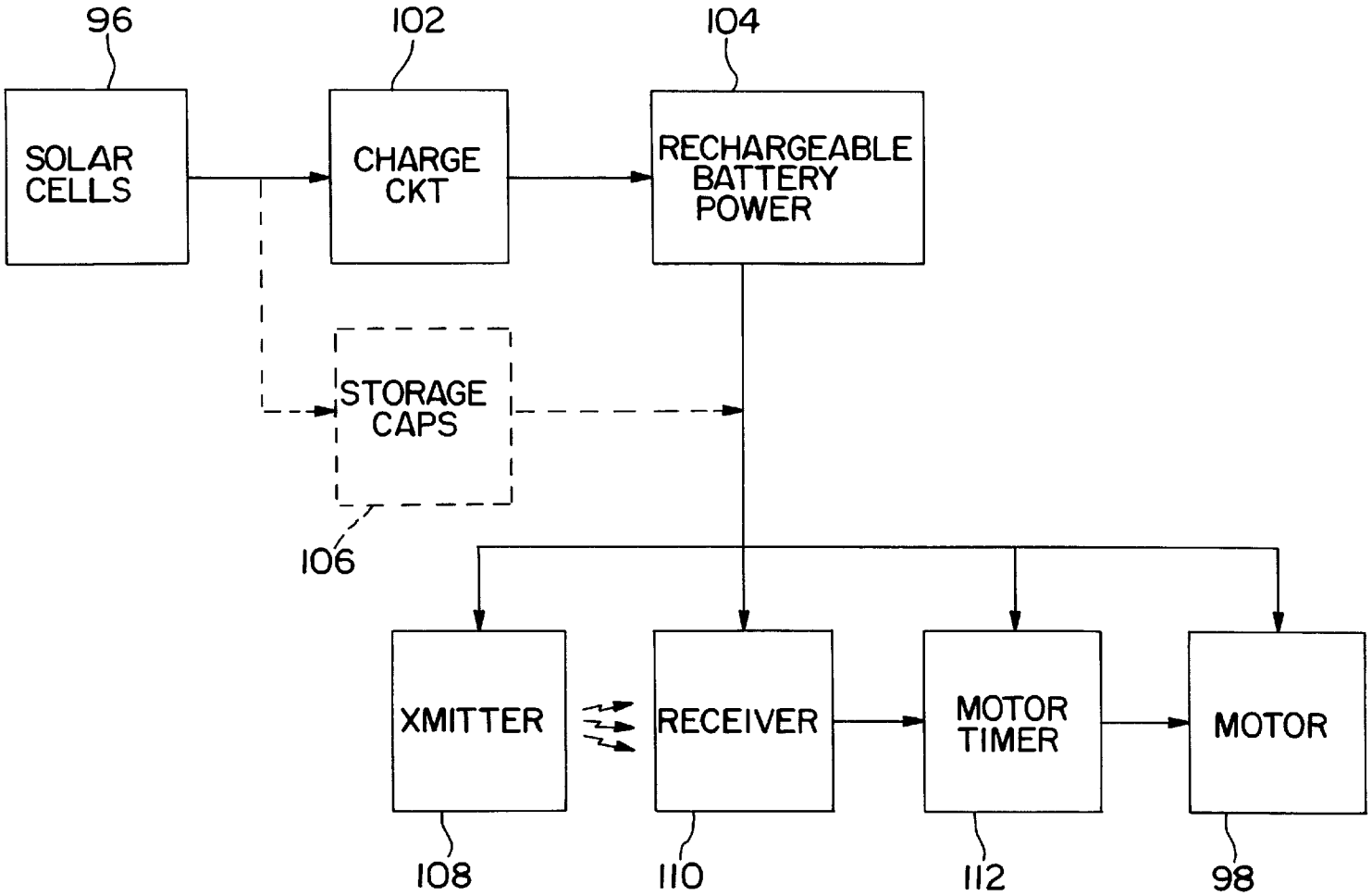
FIG. 13 is a block diagram showing various functional components that may be employed in another embodiment of a dispenser including solar power cells as shown in FIG. 11.

FIG. 13 illustrates an alternative embodiment wherein all power for operation of the device is derived from solar panel 96. As can be seen, components analogous to those of the embodiment in FIG. 12 are shown by the same reference number. The operation of this embodiment will be apparent to one skilled in the art from the above discussion.

It can thus be seen that the present invention provides a novel dispenser apparatus in furtherance of the noted objects. While presently preferred embodiments of the invention have been shown and described, it should be understood that various modifications and variations may be made thereto by those of ordinary skill in the art. In addition, it should be understood that aspects of the various embodiments may be interchanged both in whole or in part. Furthermore, those of ordinary skill in the art will appreciate that the foregoing description is by way of example only, and it is not intended to be limitative of the spirit and scope of the invention so further set forth in the following claims.

What is claimed is:

1. A dispenser for automatically dispensing viscous material, said dispenser comprising:

a base;

a cover movable between an open position and a closed position, said cover and said base defining a housing for containing components of said dispenser when said cover is in the closed position;

a disposable cartridge having a reservoir of viscous material to be dispensed through a dispensing tube, said disposable cartridge further including at least one generally flat battery;

a mechanical actuator configured to engage said dispensing tube of said disposable cartridge to cause a quantity of said viscous material to be dispensed therethrough;

detection circuitry operative to detect presence of a user's hand at a predetermined location near said dispenser; and a motor receiving operational power from said generally flat battery of said disposable cartridge, said motor operative in response to said detection circuitry to cause movement of said mechanical actuator.

2. A dispenser as set forth in claim 1, said generally flat battery defines terminal portions engaged by fixed terminals when said disposable cartridge is inserted in said housing.

3. A dispenser as set forth in claim 2, wherein said fixed terminals comprise respective spring elements to facilitate firm engagement against said terminal portions of said generally flat battery.

4. A dispenser as set forth in claim 2, wherein said generally flat battery is carried on a side surface of said disposable cartridge.

5. A dispenser as set forth in claim 1, further comprising at least one solar power cell operative to supplement power supplied by said generally flat battery.

6. A dispenser as set forth in claim 5, wherein said solar power cell is operative to charge at least one supplemental power storage component located in said housing.

7. A dispenser as set forth in claim 6, wherein said supplemental power storage component comprises at least one rechargeable battery.

8. A dispenser as set forth in claim 6, wherein said at least one supplemental power storage component comprises at least one storage capacitor.

9. A dispenser as set forth in claim 6, wherein substantially all power to operate said motor is derived from said generally flat battery of said disposable cartridge and substantially all power to operate said detection circuitry is derived from said supplemental power storage component.

10. A dispenser as set forth in claim 5, wherein said at least one solar power cell comprises a solar panel mounted on said cover.

11. A dispenser for automatically dispensing viscous material, said dispenser comprising:

a base;

a cover movable between an open position and a closed position, said cover and said base defining a housing for containing components of said dispenser when said cover is in the closed position;

a disposable cartridge having a reservoir of viscous material to be dispensed through a dispensing tube, said disposable cartridge further including a generally flat battery defining terminal portions engaged by fixed terminals when said disposable cartridge is inserted in said housing;

a mechanical actuator configured to engage said dispensing tube of said disposable cartridge to cause a quantity of said viscous material to be dispensed therethrough;

detection circuitry operative to detect presence of a user's hand at a predetermined location near said dispenser;

a motor operative in response to said detection circuitry to cause movement of said mechanical actuator;

at least one solar power cell; and at least one supplemental power storage component located in said housing and being charged by said solar power cell;

wherein substantially all power to operate said motor is derived from said generally flat battery of said disposable cartridge and substantially all power to operate said detection circuitry is derived from said supplemental power storage component.

12. A dispensed as set forth in claim 11, wherein said supplemental power storage component comprises at least one rechargeable battery.

13. A dispenser as set forth in claim 12, wherein said rechargeable battery comprises a nonmemory-type battery.

14. A dispenser as set forth in claim 13, wherein said nonmemory-type battery is selected from a group consisting of nickel-metal-hydride batteries or lithium ion batteries.

15. A dispenser as set forth in claim 11, wherein said at least one supplemental power storage component comprises at least one storage capacitor.

16. A dispenser as set forth in claim 11, wherein said at least one solar power cell comprises a solar panel mounted on said cover.

17. A dispenser as set forth in claim 11, wherein said solar power cell is adapted to be suitably efficient in conditions of fluorescent lighting.

18. A dispenser for automatically dispensing viscous material, said dispenser comprising:

a wall-mounted housing;

a disposable cartridge having a reservoir of viscous material to be dispensed, said disposable cartridge further including a generally flat battery defining terminal portions engaged by fixed terminals when said disposable cartridge is inserted in said housing;

a mechanical actuator operative to cause a quantity of said viscous material to be dispensed from said reservoir;

detection circuitry including an light emitter and a light sensitive receiver, said detection circuitry operative to detect presence of a user's hand at a predetermined location near said dispenser;

a motor operative in response to said detection circuity to cause movement of said mechanical actuator;

at least one solar power cell located on said housing to receive ambient light; and at least one supplemental power storage component located in said housing and being charged by said solar power cell;

wherein substantially all power to operate said motor is derived from said generally flat battery of said disposable cartridge and substantially all power to operate said detection circuitry is derived from said supplemental power storage component.

19. A dispenser as set forth in claim 18, wherein said supplemental power storage component comprises at least one rechargeable battery.

20. A dispenser as set forth in claim 19, wherein said rechargeable battery comprises a nonmemory-type battery.

21. A dispenser as set forth in claim 20, wherein said nonmemory-type battery is selected from a group consisting of nickel-metal-hydride batteries or lithium ion batteries.

22. A dispenser as set forth in claim 18, wherein said at least one supplemental power storage component comprises at least one storage capacitor.

* * * * *